US010589337B2

(12) United States Patent
Na

(10) Patent No.: US 10,589,337 B2
(45) Date of Patent: Mar. 17, 2020

(54) HIGH-FREQUENCY HEATING APPARATUS FOR PROGRESSIVE DIE AND HIGH-FREQUENCY HEATING METHOD USING THE SAME

(71) Applicant: KOREA PRECISION CO., LTD., Gwangju (KR)

(72) Inventor: Young Seck Na, Gwangju (KR)

(73) Assignee: Korea Precision Co., Ltd., Gwangju (KR)

( * ) Notice: Subject to any disclaimer, the term of this patent is extended or adjusted under 35 U.S.C. 154(b) by 370 days.

(21) Appl. No.: 15/550,528

(22) PCT Filed: Oct. 25, 2016

(86) PCT No.: PCT/KR2016/012018
§ 371 (c)(1),
(2) Date: Aug. 11, 2017

(87) PCT Pub. No.: WO2018/070582
PCT Pub. Date: Apr. 19, 2018

(65) Prior Publication Data

US 2018/0236524 A1 Aug. 23, 2018

(30) Foreign Application Priority Data

Oct. 11, 2016 (KR) ..... 10-2016-0131534

(51) Int. Cl.
*H05B 6/10* (2006.01)
*H05B 6/04* (2006.01)
(Continued)

(52) U.S. Cl.
CPC ..... *B21D 37/16* (2013.01); *B21D 37/10* (2013.01); *H05B 6/101* (2013.01); *H05B 6/62* (2013.01)

(58) Field of Classification Search
CPC ..... H05B 6/101; H05B 6/102; H05B 6/104; H05B 6/40; H05B 6/44; H05B 6/62; B21D 37/10; B21D 37/16
(Continued)

(56) References Cited

U.S. PATENT DOCUMENTS 4,849,598 A * 7/1989 Nozaki ..... B05D 3/0281 219/601
2012/0234824 A1 9/2012 Nakatsu et al.
(Continued)

FOREIGN PATENT DOCUMENTS

JP 2003-231963 A 8/2003
JP 2005-325409 A 11/2005
(Continued)

*Primary Examiner* — Hung D Nguyen
(74) *Attorney, Agent, or Firm* — Rabin & Berdo, P.C.

(57) ABSTRACT

A high-frequency heating apparatus includes: an open-top shield housing made of a ferrite material; a plurality of main high-frequency oscillation members radially arranged around the center of the shield housing; main extension/reduction transfer members configured to transfer the main high-frequency oscillation members; and a high-frequency oscillation controller configured to cause the main high-frequency oscillation members to generate high-frequency waves; wherein each of the main high-frequency oscillation members includes: a main oscillator housing configured to have a high-frequency wave emission hole; a main high-frequency oscillator configured to generate high-frequency waves; and a main high-frequency wave disperser configured to have a high-frequency wave dispersion hole; and wherein the main extension/reduction transfer members include respective main solenoid plungers configured to selectively move the main oscillator housings forward and backward.

5 Claims, 7 Drawing Sheets

(51) Int. Cl.

| | |
|---|---|
| ***B21D 37/16*** | (2006.01) |
| ***H05B 6/62*** | (2006.01) |
| ***B21D 37/10*** | (2006.01) |
| *H05B 6/36* | (2006.01) |

(58) Field of Classification Search
USPC ..... 219/600, 635, 662, 671, 672, 676
See application file for complete search history.

(56) References Cited

U.S. PATENT DOCUMENTS

| | | | | |
|---|---|---|---|---|
| 2014/0144904 | A1* | 5/2014 | Nakatsu | H05B 6/44 219/650 |
| 2017/0144208 | A1* | 5/2017 | Mikami | B21D 22/14 |
| 2018/0338353 | A1* | 11/2018 | Chang | H05B 6/102 |

FOREIGN PATENT DOCUMENTS

| | | | |
|---|---|---|---|
| KR | 10-1987-0008601 | A | 10/1987 |
| KR | 20-2000-0003481 | U | 2/2000 |
| KR | 20-2000-0018306 | U | 10/2000 |
| KR | 10-2001-0104140 | A | 11/2001 |
| KR | 10-2010-0001310 | A | 1/2010 |
| KR | 10-2012-0105384 | A | 9/2012 |

* cited by examiner

View B

View B

HIGH-FREQUENCY HEATING APPARATUS FOR PROGRESSIVE DIE AND HIGH-FREQUENCY HEATING METHOD USING THE SAME

TECHNICAL FIELD

The present invention relates generally to a high-frequency heating apparatus which is applied to a progressive die and applies heat to an object to be heated (a metallic material), i.e., a formation target object, thereby enabling hot forming. More specifically, the present invention relates to a high-frequency heating apparatus for a progressive die, which softens a crack and predicted formation change portion of a metallic material by locally heating the portions by means of high-frequency waves, thereby contributing to the prevention of a crack and the improvement of formability, and also relates to a high-frequency heating method using the same.

BACKGROUND ART

High-frequency heating is classified into induction heating and dielectric heating according to the physical properties of an object to be heated. The former is chiefly used to heat a conductive metal, and the later is chiefly used to heat a material having dielectric loss, i.e., water, paper, plastic, etc.

Furthermore, high-frequency heating is classified according to the frequency of a heating power source, as shown in Table 1 below. In particular, the frequencies used for high-frequency induction heating may be subdivided into low frequencies (operating frequencies of 50 to 60 Hz), intermediate frequencies (100 to 10 KHz), high frequencies (10 to 500 KHz), and radio frequencies (100 to 500 KHz). In particular, heating using intermediate frequencies, high frequencies, and radio frequencies is referred to as high-frequency heating.

TABLE 1

| Frequency (Hz) | Wavelength (m) | Frequency name | | Communication-related purpose | Industrial purpose |
|---|---|---|---|---|---|
| 30K to 300K | $10^4$ to $10^3$ | LF | intermediate wave | general radio broadcasting | high-frequency induction heating |
| 300K to 3M | 10 to 10 | MF | | | |
| 3M to 30M | 10 to 10 | HF | short wave | short wave broadcasting wireless communication | high frequency induction heating |
| 30M to 300M | 10 to 1 | VHF | ultra-short wave | TV broadcasting | |
| 300M to 3 G | 1 to 0.1 | UHF | micro-wave | TV broadcasting communication radar | micro-wave heating |
| 3 G to 30 G | 0.1 to 0.01 | SHD | | | |
| 30 G to 300 G | 0.01 to 0.001 | EHF | | | |

Meanwhile, all materials may be basically classified with conductivity and dielectricity. In connection with conductivity, when electricity is applied to a material, the electricity does not stay at a given location and flows to a lower voltage location. A material has resistance to the flow of electricity. According to the degree of resistance, a material having low resistance is called a conductive material or a conductor, whereas a material having high resistance is called a non-conductor.

Furthermore, the values of dielectricity are represented by dielectric constants, unlike those of resistance. However, when the values of dielectricity are represented by specific resistance values, a material used as a dielectric is a non-conductor having a high specific resistance value. Accordingly, all materials may be classified with conductivity and dielectricity.

Next, when the materials classified as described above are paired with high-frequency heating targets, conductors can be heated through induction heating, and dielectrics can be heated through dielectric heating using dipole vibration, with the result that all the materials can be targets of high-frequency heating.

Furthermore, induction heating is subdivided into heating using hysteresis loss and heating using an eddy current according to their heating principle. Of these materials, magnetic materials can be heated through both the heating methods using the above two types of loss, respectively. Unfortunately, nonmagnetic materials cannot be heated through heating using hysteresis loss, and thus have low heating efficiency. However, nonmagnetic materials may be used as the materials of containers containing objects to be heated during high-frequency heating by utilizing the above-described disadvantageous point. High-frequency heating has the following advantages over other methods, such as electrical heating and fuel heating, and thus has rapidly extended to a wide variety of fields recently.

The first advantage of high-frequency heating is outstanding economic feasibility.

In other words, in induction heating, an object to be heated is directly heated by itself, and thus high efficiency is achieved. Accordingly, although equipment manufacturing cost is expensive, total production cost can be reduced to half or less of that in other fuel devices.

Second, high quality can be ensured. In other words, if an appropriate frequency is selected according to the material and size of an object to be heated, uniform temperature, speed, etc. can be controlled as desired, and thus individual parts can be produced through mass production (in particular, the enablement of selective heating, such as local heating or surface quenching, is an essential condition for economic feasibility and heat treatment technology).

Third, non-contact heating can completely isolate and block an object to be heated from a heating source, and thus can prevent various types of contamination. Non-contact heating can be applied to the process of manufacturing silicon for semiconductor wafers (this method enables heating at an ultra-high temperature equal to or higher than 3000° C. and heating in various types of gas atmospheres or in a vacuum state, and thus is recently used in the fields of application of state-of-art technology).

Fourth, work can be rapidly done on a second basis. In other words, most of high-frequency heating for heat treatment, metal bonding, drying, etc. can be performed on a second basis. Such rapid performance enables the introduction of a tack system which can synchronize production speed with previous and next processes (pressing and heat treatment) when the prevention of a change in material and the mass production of a part, such as an automation component, are required. This is a great advantage which is unthinkable in the case of heating using other fuel devices.

Fifth, the use of a material can be reduced. In other words, when this method is used for tinning, tin is instantaneously melt and comes into tight and uniform contact with a surface of a steel plate. Accordingly, desirable coating can be achieved even using ⅓ of the amount of tin required for a conventional method of performing dipping in a tin melt.

As related conventional technologies, Korean Utility Model Application Publication No. 20-2000-0003481, Korean Patent Application Publication No. 10-1987-0008601, and Korean Utility Model Application Publication No. 20-2000-0018306 are disclosed.

However, so far, there has been no case where the high-frequency heating apparatus is applied to the field of progressive dies. Accordingly, conventionally, during the formation of products, cracks occur due to a component of a material, a temperature condition (winter) during work, and an increase in brittleness attributable to the cooling of a material. Furthermore, problems arise in that a defective rate increases and productivity decreases due to changes in the dimensions of products.

Furthermore, products must be formed by taking into account the differences in the elongation of materials based on the shapes of the products, and thus the enlargement of dies is required due to an increase in the number of processes (first forming, second forming, and third forming). Furthermore, in the bending of high tension steel plates, there is difficulty in forming products due to excessive spring back.

DISCLOSURE

Technical Problem

An object of the present invention is to provide a high-frequency heating apparatus for a progressive die, which softens a crack and predicted formation change portion of an object to be heated (a metallic material) by locally heating the portions by means of high-frequency waves, thereby contributing to the prevention of a crack and the improvement of formability.

Furthermore, another object of the present invention is to provide a high-frequency heating method using the high-frequency heating apparatus for a progressive die.

Technical Solution

In order to accomplish the above objects, according to an aspect of the present invention, there is provided a high-frequency heating apparatus for a progressive die, the high-frequency heating apparatus including: an open-top shield housing made of a ferrite material having the effect of desirably shielding electromagnetic waves; a plurality of main high-frequency oscillation members radially arranged around the center of the shield housing; main extension/reduction transfer members configured to transfer the main high-frequency oscillation members in the directions in which an arrangement radius is selectively extended and reduced; and a high-frequency oscillation controller configured to activate the main high-frequency oscillation members by applying high-frequency signals to the main high-frequency oscillation members, thereby causing the main high-frequency oscillation members to generate high-frequency waves; wherein each of the main high-frequency oscillation members includes: a main oscillator housing configured to have a high-frequency wave emission hole in the top thereof; a main high-frequency oscillator configured to generate high-frequency waves via the high-frequency wave emission hole in the state of being installed inside the main oscillator housing; and a main high-frequency wave disperser coupled to the top of the main oscillator housing, and configured to have a high-frequency wave dispersion hole adapted to disperse the high-frequency waves, emitted via the high-frequency wave emission hole, to the outside; and wherein the main extension/reduction transfer members include respective main solenoid plungers configured to selectively move the main oscillator housings, containing the respective main high-frequency oscillators, forward and backward in the direction of the center of the shield housing in the state of being radially installed along the outer circumferential surface of the shield housing.

Furthermore, the high-frequency heating apparatus may further include a location control means configured to control the locations of the main high-frequency oscillation members; and the location control means may include: a location detection sensor configured to detect a heating target point of the object to be heated in response to an operation of one of the main solenoid plungers in the state of being installed at the front end of the specific one of the oscillator housings, wherein when the heating target point of the object to be heated is detected by the location detection sensor, the specific one of the main high-frequency oscillation members on which the location detection sensor has been installed maintains a detection location, and the remaining ones of the main high-frequency oscillation members are automatically arranged in accordance with the location of the specific main high-frequency oscillation member as the degrees of forward or backward movement of corresponding ones of the main solenoid plungers are adjusted in response to control signals of the control unit.

Furthermore, the high-frequency heating apparatus may further include: auxiliary high-frequency oscillation members configured to selectively generate high-frequency waves by means of the high-frequency oscillation controller in response to control signals of the control unit in the state of being disposed between the main high-frequency oscillation members; and auxiliary extension/reduction transfer members configured to transfer the auxiliary high-frequency oscillation members in the directions in which the arrangement radius is selectively extended and reduced; each of the auxiliary high-frequency oscillation members may include: an auxiliary oscillator housing configured to have a high-frequency wave emission hole in the top thereof; an auxiliary high-frequency oscillator configured to generate high-frequency waves via the high-frequency wave emission hole in the state of being installed inside the auxiliary oscillator housing; and an auxiliary high frequency disperser coupled to the top of the auxiliary oscillator housing, and configured to have a high-frequency wave dispersion hole adapted to disperse the high-frequency waves, emitted via the high-frequency wave emission hole, to the outside; and the auxiliary extension and reduction transfer members may include auxiliary solenoid plungers configured to selectively move the auxiliary oscillator housings, containing the respective auxiliary high-frequency oscillators, forward and backward in the direction of the center of the shield housing in the state of being disposed between the main solenoid plungers along the outer circumferential surface of the shield housing.

According to another aspect of the present invention, there is provided an object high-frequency heating method for a progressive die using the high-frequency heating apparatus for a progressive die, the method including: when the object to be heated reaches a predetermined location, detecting a heating target point of the object to be heated by means of the location detection sensor while the specific main solenoid plunger is selectively moving forward and backward; when the heating target point is detected, arranging the specific main high-frequency oscillation member at the location, at which the specific main high-frequency oscillation member can heat the heating target point of the object to be heated, by stopping the specific main solenoid plunger at a detection point; arranging all main high-frequency oscillation members, connected to the remaining main solenoid plungers, at locations, at which the main high-frequency oscillation members can heat the heating target point of the object to be heated, by operating the remaining main solenoid plungers to the location, at which the specific main solenoid plunger has been stopped, by means of the control unit; detecting the thickness of the object to be heated, and setting high-frequency oscillation time in the main high-frequency oscillators in proportion to the thickness; and heating the heating target point of the object to be heated by generating high-frequency waves by means of the main high-frequency oscillators in accordance with the set time.

Advantageous Effects

According to the technical solutions, a crack and predicted formation change portion of an object to be heated (a metallic material) are softened by locally heating the portions by means of high-frequency waves, thereby contributing to the prevention of a crack and the improvement of formability and also improving the degree of completion of die work and productivity.

MODE FOR INVENTION

Embodiments of the present invention will be described in detail below with reference to the accompanying drawings. The same reference symbols will be used for the same components across the drawings, and redundant descriptions thereof will be omitted.

Figure 1:
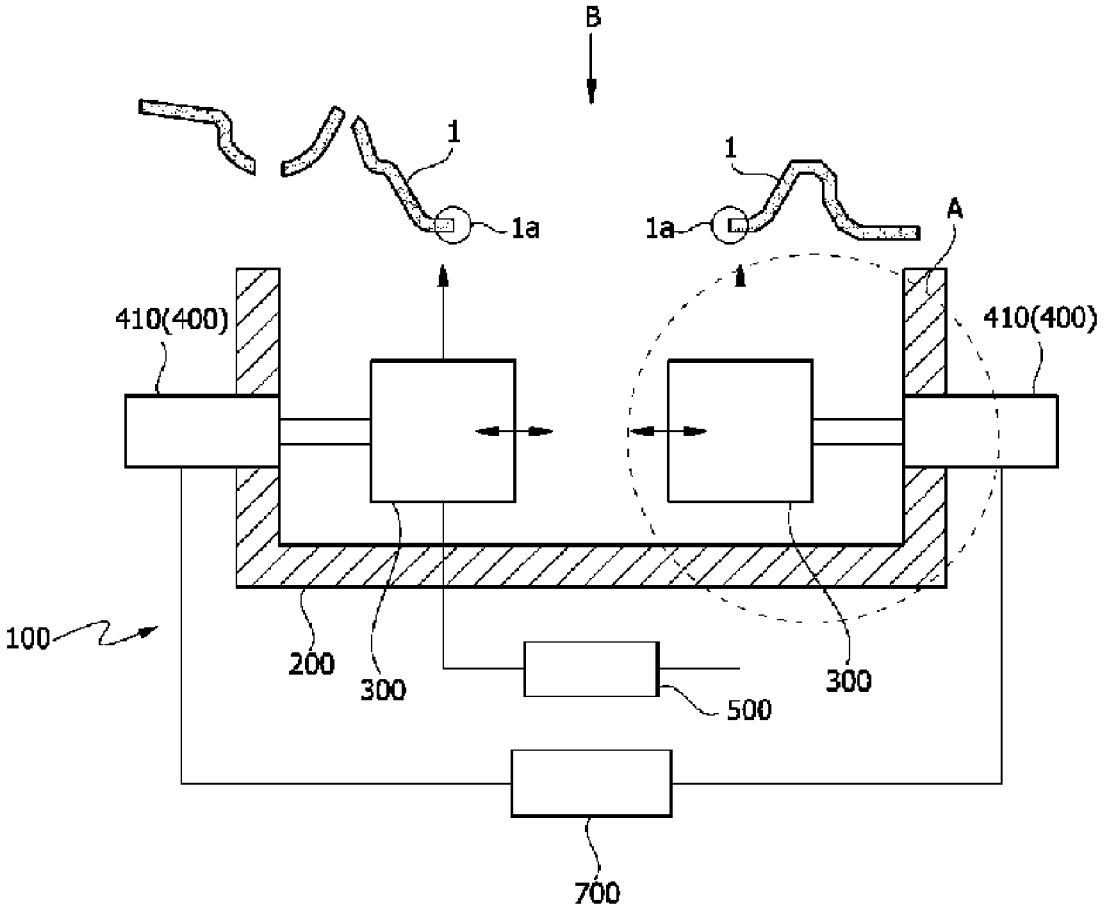
FIG. 1 is a view showing the schematic configuration of a high-frequency heating apparatus for a progressive die according to the present invention.
Figure 2:
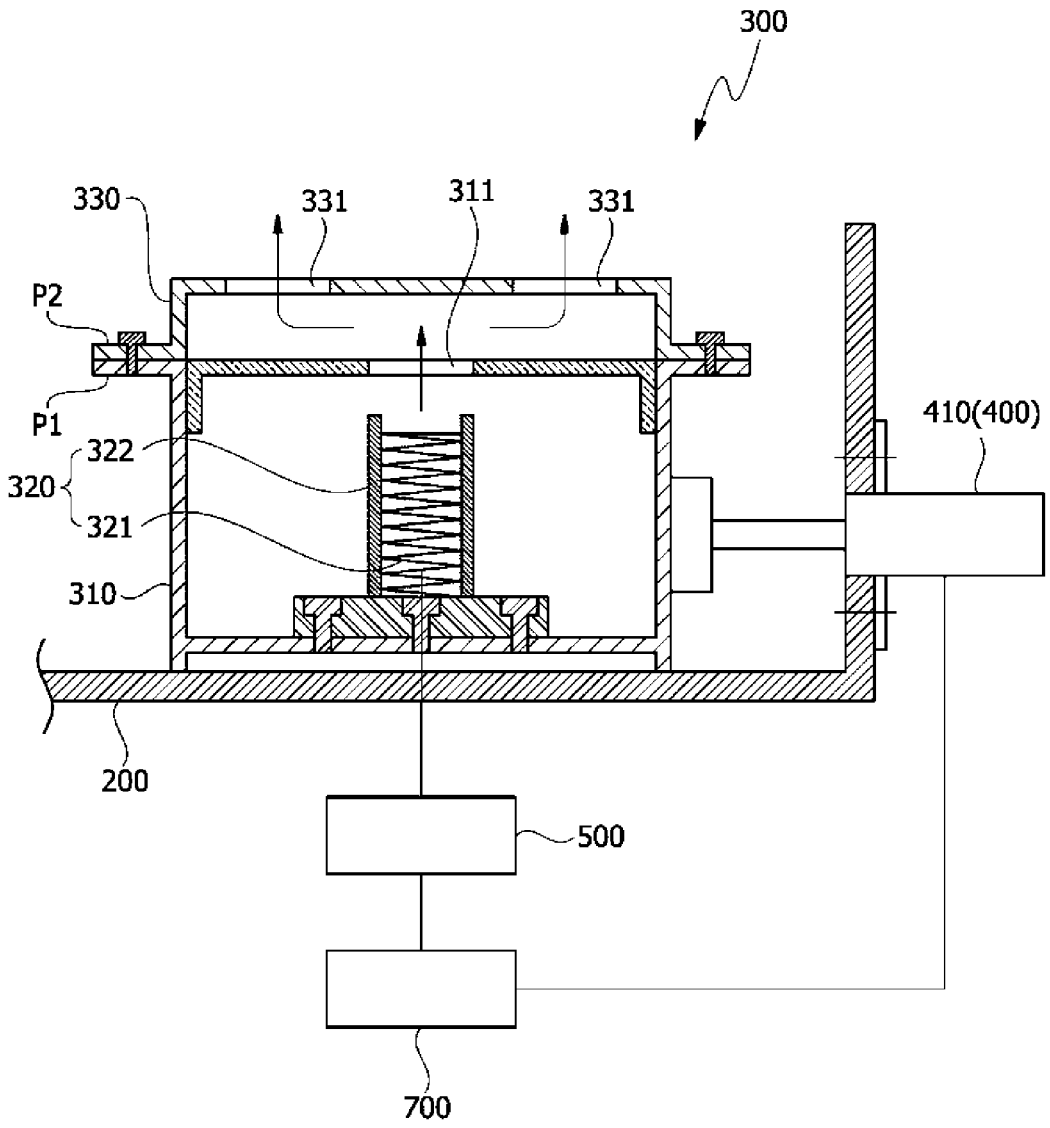
FIG. 2 is a detailed view of portion A of FIG. 1.
Figure 3:
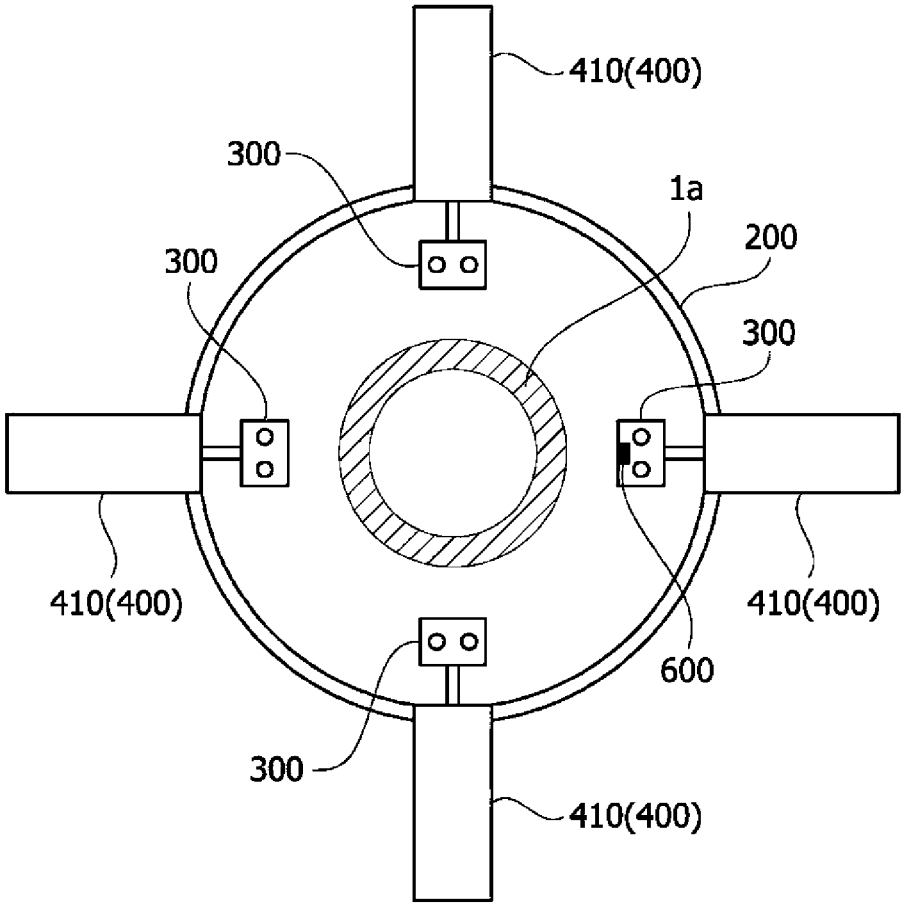
FIG. 3 is a view when viewed in direction B of FIG. 1, which shows a state before main high-frequency oscillation members are located at the heating target point of an object to be heated.
Figure 4:
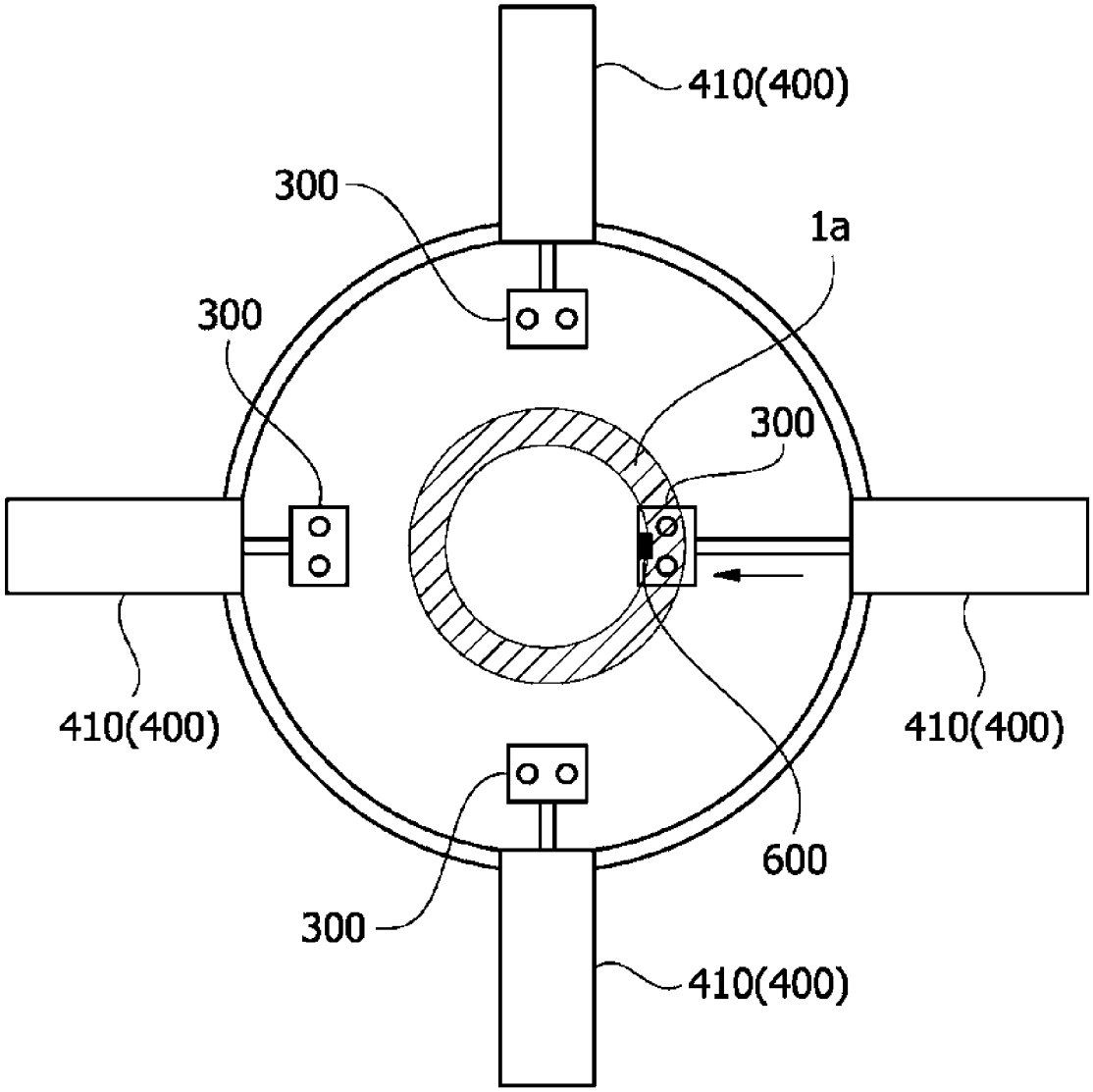
FIG. 4 is a view when viewed in direction B of FIG. 1, which shows the state in which a specific one of the main high-frequency oscillation members is located at the heating target point of the object to be heated.
Figure 5:
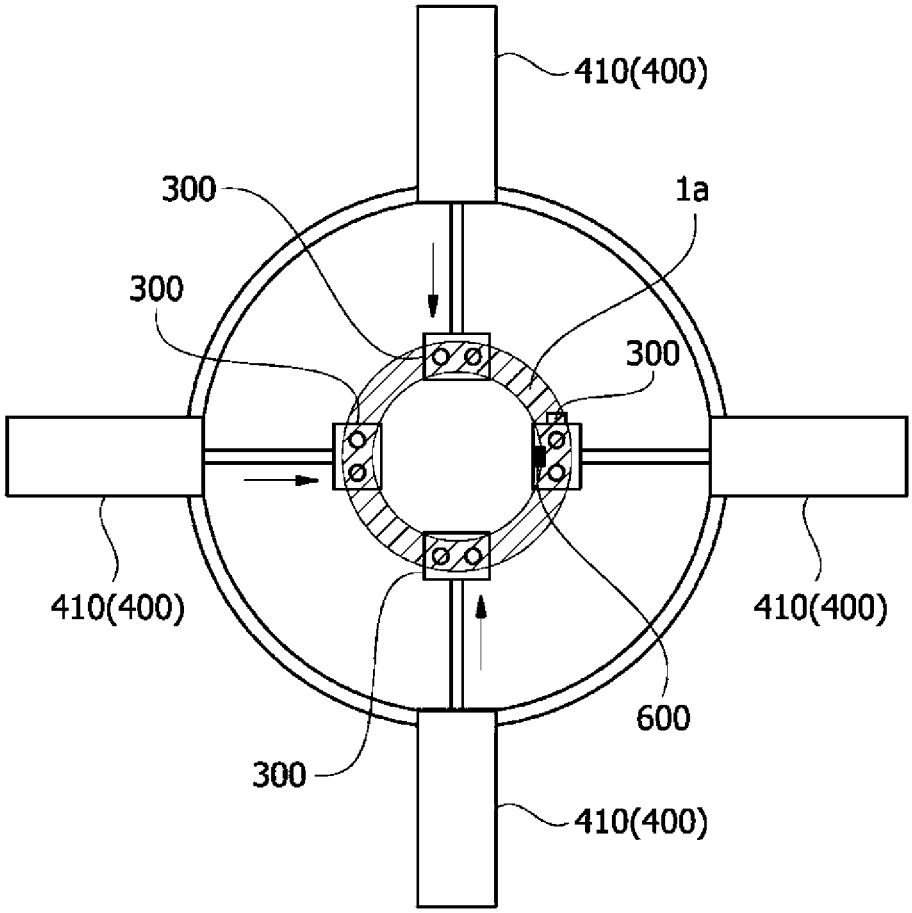
FIG. 5 is a view when viewed in direction B of FIG. 1, which shows the state in which the remaining ones of the main high-frequency oscillation members are located at the heating target point of the object to be heated.

The accompanying FIG. 1 is a view showing the schematic configuration of a high-frequency heating apparatus for a progressive die according to the present invention, FIG. 2 is a detailed view of portion A of FIG. 1, FIG. 3 is a view when viewed in direction B of FIG. 1, which shows a state before main high-frequency oscillation members are located at the heating target point of an object to be heated, FIG. 4 is a view when viewed in direction B of FIG. 1, which shows the state in which the main high-frequency oscillation members are located at the heating target point of the object to be heated, and FIG. 5 is a view showing the state in which auxiliary high-frequency oscillation members according to the present invention are installed.

Referring to FIGS. 1 to 5, a high-frequency heating apparatus 100 according to the present invention is applied to, for example, a progressive die, applies heat to the formation portion of an object 1 to be heated, i.e., a formation target object, to thus soften the formation portion, thereby enabling hot forming. The high-frequency heating apparatus 100 includes a shield housing 200, main high-frequency oscillation members 300, main extension/reduction transfer members 400, and a high-frequency oscillation controller 500.

The shield housing 200 is intended to contain the main high-frequency oscillation members 300. The shield housing 200 is preferably made of a ferrite material having a desirable electromagnetic wave shielding effect in order to prevent high-frequency waves, generated by the main high-frequency oscillation members 300, from leaking to the outside.

In particular, NiCuZn ferrite may be applied to the shield housing 200.

In this case, the chemical composition ratio applicable to the widest frequency band is 49.0 mol % of $Fe_2O_3$, 9.0 mol % of NiO, 8.0 mol % of CuO, and 34.0 mol % of ZnO. As a result of the observation of a ferrite state after calcining raw materials, mixed at the above chemical composition ratio, at 900° C., forming obtained ferrite and then sintering the ferrite at 1080° C., an optimum state was exhibited in the form of crystal grains having sizes in the range from 5 to 10 μm. When an average particle size was 1.12 μm, the best loss tangent and the best electromagnetic wave shielding characteristic were exhibited.

Accordingly, the shield housing 200 having the above condition has reliability which ensures the complete shielding of electromagnetic waves without the leakage of high-frequency waves.

As shown in FIGS. 2 to 5, the main high-frequency oscillation members 300 are intended to generate high-frequency waves and to heat the heating target point 1*a* of the object 1 to be heated (shown in FIG. 1). The main high-frequency oscillation members 300, which are plural in number, may be radially arranged at predetermined intervals around the center of the shield housing 200.

Each of the main high-frequency oscillation members 300 may include a main oscillator housing 310, a main high-frequency oscillator 320, and a main high-frequency wave disperser 330.

The main oscillator housing 310 is intended to contain the main high-frequency oscillator 320. The main oscillator housing 310 may be constructed in a cylindrical shape having a bottom surface. A high-frequency wave emission hole 311 configured to emit high-frequency waves may be formed in the top of the oscillator housing 310. In this case, the main oscillator housing 310 is also preferably made of a ferrite material capable of shielding electromagnetic waves, like the shield housing 200.

The main high-frequency oscillator 320 generates high-frequency waves via the high-frequency wave emission hole 311 in the state of being installed at the center of the main oscillator housing 310. The main high-frequency oscillator 320 may include a high-frequency oscillation coil 321, and an insulator 322 configured to surround the outer circumferential surface of the high-frequency oscillation coil 321.

In this case, the insulator 322 may be composed of, for example, Teflon tape. The Teflon tape is made of synthetic resin having a structure in which it has the same bonds as polyolefin having C—C bonds and part or all of hydrogen of polyolefin have been replaced with fluorine atoms.

Eight types of fluorine resin have been commercialized. 70% of these types of fluorine resin corresponds to polytetrafluoroethylene (PTFE), which is representative. PTFE is crystalline resin known as the trade name "Teflon." PTFE is unique plastic which has heat resistance in long-term use at 260° C. and also has chemical resistance, an electric insulation property, high-frequency characteristics, a non-adhesiveness property, a low frictional coefficient, a flame retarding property, etc. In particular, PTFE is suitable for application to the main high-frequency oscillators 320 in that it has an insulation property and high-frequency characteristics.

The main high-frequency wave disperser 330 is intended to disperse high-frequency waves, emitted via the high-frequency wave emission hole 311, into a plurality of waves in the state of being coupled to the main oscillator housing 310. Two or more high-frequency wave dispersion holes 331 may be formed in the top of the main high-frequency wave disperser 330. The main high-frequency wave disperser 330 enables high-frequency waves, emitted via the high-frequency wave emission hole 311, to propagate to the outside in the state of being dispersed into a plurality of waves, thereby enabling high-frequency waves to be dispersed and propagate across a wide area. High-frequency waves have a rectilinear propagation property due to their characteristic. Accordingly, when a large number of high-frequency wave dispersion holes are formed, high-frequency waves may be weakened, and thus two high-frequency wave dispersion holes are viewed as being suitable.

Meanwhile, the main oscillator housing 310 and the main high-frequency wave disperser 330 may have a coupling structure in which coupling flanges P1 and P2 are formed on the peripheries of the main oscillator housing 310 and the main high-frequency wave disperser 330 and the flanges P1 and P2 are brought face to face with each other and are fastened to each other by screws. However, the coupling structure is not limited thereto.

The main extension/reduction transfer members 400 function to transfer the main oscillator housings 310 in the directions in which an arrangement radius is selectively extended and reduced according to the size of the heating target point 1*a* of the object 1 to be heated by selectively moving the main oscillator housings 310 forward and backward in the direction of the center of the shield housing 200.

The main extension/reduction transfer members 400 may include main solenoid plungers 410 configured to selectively move the main oscillator housings 310, containing the respective main high-frequency oscillators 320, forward and backward in the direction of the center of the shield housing 200 in the state of being radially installed along the outer circumferential surface of the shield housing 200. The main solenoid plungers 410 enable fine forward and backward movement, and are thus suitable for the accurate location control of small-sized parts.

The high-frequency oscillation controller 500 functions to enable high-frequency waves to be generated by activating the high-frequency oscillation members 300 through the application of a high-frequency signal to the high-frequency oscillation members 300. Although the high-frequency oscillation controller 500 may be manually controlled by an operator, it is preferred that the high-frequency oscillation controller 500 is automatically controlled in terms of operation efficiency.

Meanwhile, as shown in FIGS. 4 and 5, the high-frequency heating apparatus for a progressive die 100 according to the present invention may include a location control means configured to control the locations of the main high-frequency oscillation members 300. In this case, the location control means may include a location detection sensor 600 configured to detect the heating target point 1*a* of the object 1 to be heated in response to the operation of the main solenoid plunger 410 in the state of being installed at the front end of a specific one of the plurality of main oscillator housings 310.

The specific main high-frequency oscillation member on which the location detection sensor 600 has been installed is maintained at a detection location when the heating target point 1*a* of the object 1 to be heated is detected by the location detection sensor 600, as shown in FIG. 4, and the remaining main high-frequency oscillation members are automatically arranged in accordance with the location of the specific main high-frequency oscillation member as the corresponding main solenoid plungers are selectively moved forward and backward in response to control signals of the control unit 700, as shown in FIG. 5, thereby enabling the main high-frequency oscillation members 300 to be radially and uniformly arranged at the locations.

This configuration is intended to simplify the configuration in such a manner that the location detection sensor 600 is installed on any one of the main high-frequency oscillation members 300 without a need to be installed on all the main high-frequency oscillation members 300 and the locations of the remaining main high-frequency oscillation members are controlled by the installed location detection sensor 600.

Figure 6:
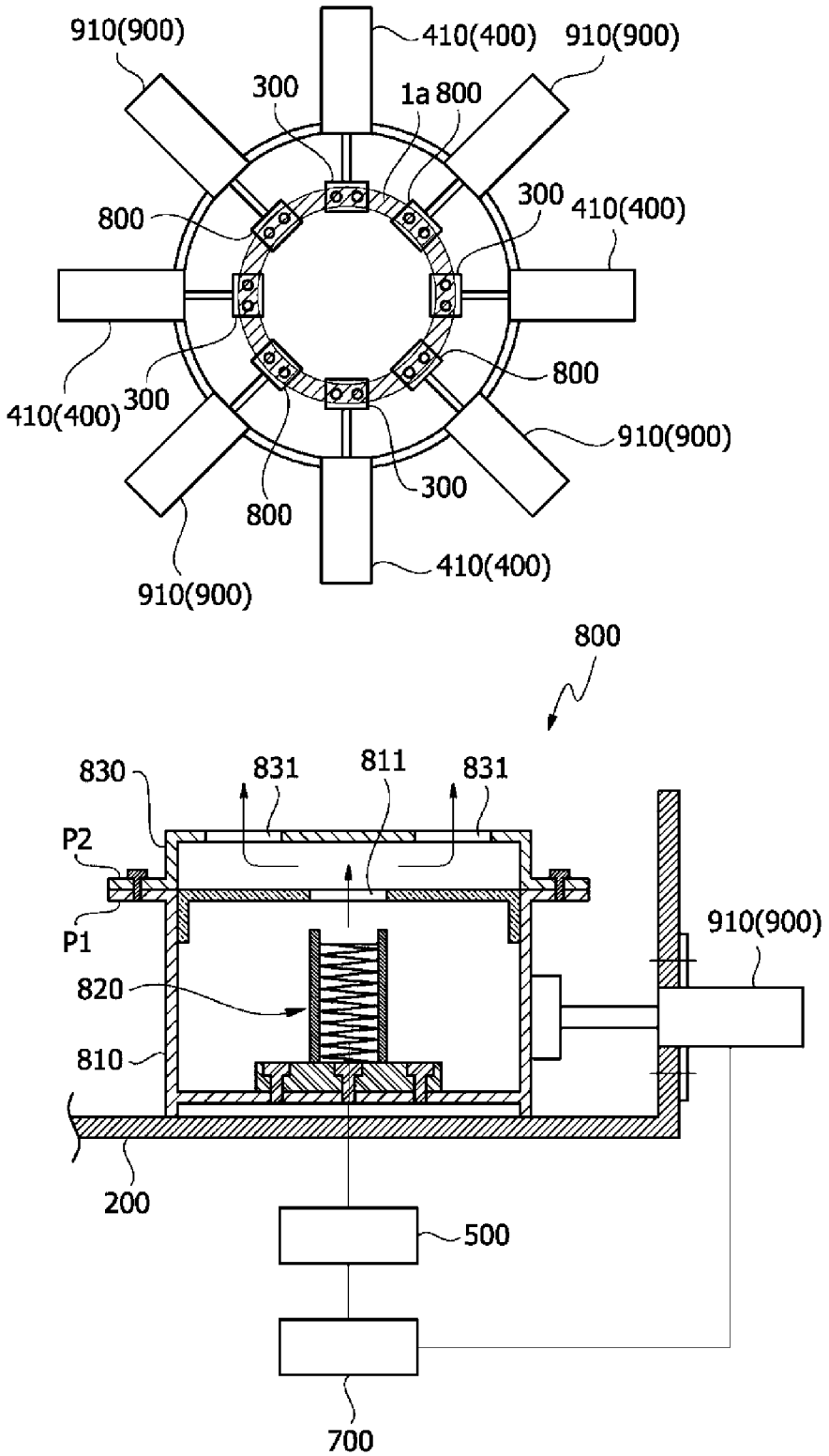
FIG. 6 is a view showing the state in which auxiliary high-frequency oscillation members according to the present invention are installed.

Meanwhile, as shown in FIG. 6, the high-frequency heating apparatus for a progressive die 100 according to the present invention may further include: auxiliary high-frequency oscillation members 800 configured to selectively generate high frequency by means of the high-frequency oscillation controller 500 in response to a control signal of the control unit 700 in the state of being arranged between the main high-frequency oscillation members 300; and auxiliary extension/reduction transfer members 900 configured to transfer the auxiliary high-frequency oscillation members 800 in the directions in which the arrangement radius is selectively extended and reduced.

These auxiliary high-frequency oscillation members 800 are intended to provide additional heating means between the main high-frequency oscillation members 300 by taking into account the fact that when the interval between the main high-frequency oscillation members 300 is extended and the interval is excessively wide, the overall heating target point 1*a* of the object 1 to be heated is not heated.

In this case, the auxiliary high-frequency oscillation members 800 above have a configuration similar to that of the above-described main high-frequency oscillation members 300. In other words, each of the auxiliary high-frequency oscillation members 800 may include: an auxiliary oscillator housing 810 configured to have a high-frequency wave emission hole 811 formed in the top thereof; an auxiliary high-frequency oscillator 820 configured to generate high-frequency waves via the high-frequency wave emission hole 811 in the state of being installed inside the auxiliary oscillator housing 810; and an auxiliary high frequency disperser 830 coupled to the top of the auxiliary oscillator housing 810, and configured to have high-frequency wave dispersion holes 831 configured to disperse the high-frequency waves, emitted via the high-frequency wave emission hole 811, to the outside.

Furthermore, the auxiliary extension and reduction transfer members 900 may include auxiliary solenoid plungers 910 configured to move the auxiliary oscillator housings 810 containing the auxiliary high-frequency oscillators 820 forward or backward in the direction of the center of the shield housing 200 in the state of being arranged on the outer circumferential surface of the shield housing 200 between the main solenoid plungers 410.

Figure 7:
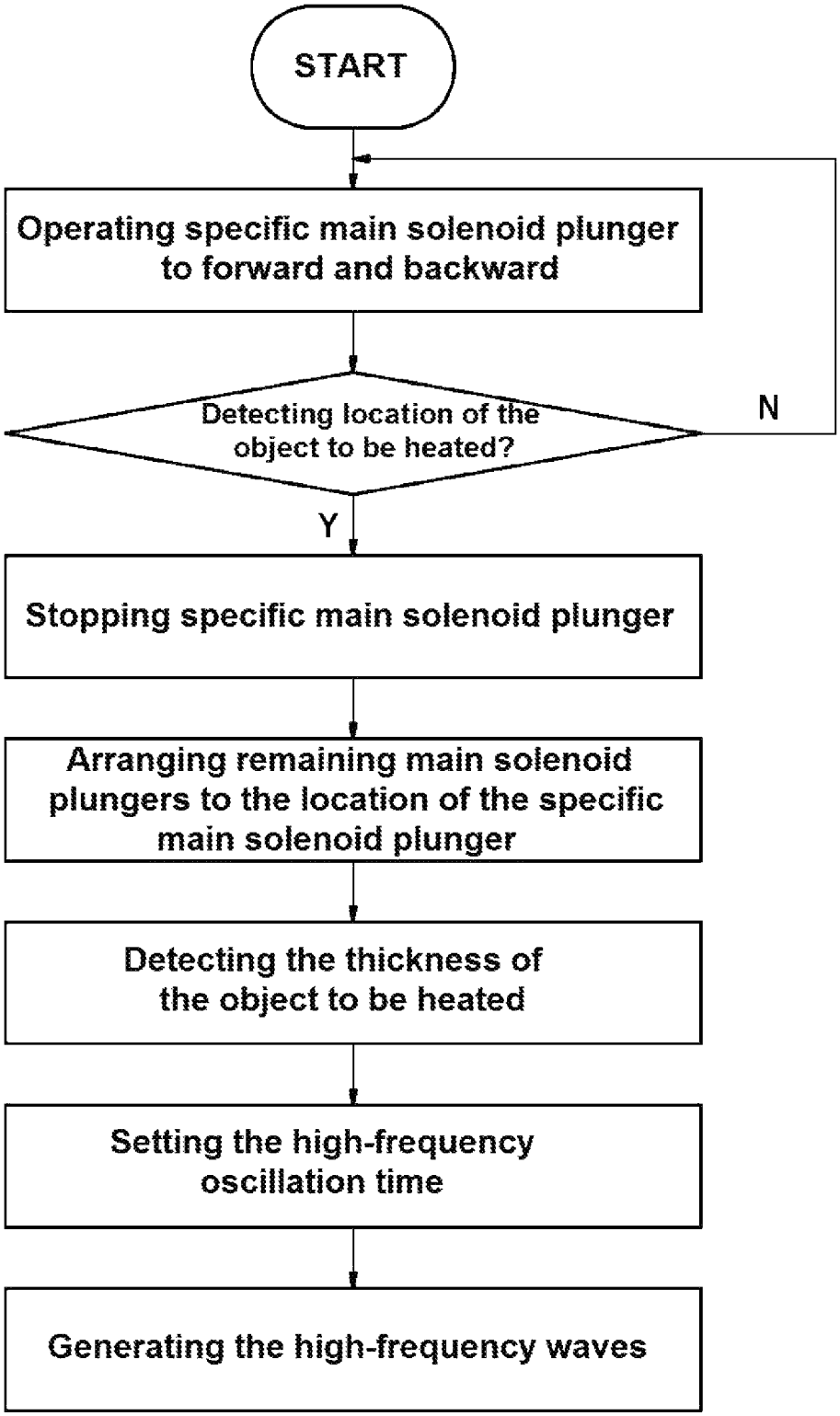
FIG. 7 is a flowchart of a high-frequency heating method for a progressive die according to the present invention.

The operation of the present invention is described as below (see FIG. 7). A description of a high-frequency heating method for a progressive die described in the attached claims is replaced with the following description of the operation.

First, when the object 1 to be heated reaches a predetermined location, the heating target point 1*a* of the object 1 to be heated is detected by the location detection sensor 600 as the main solenoid plunger 410 is moved forward or backward.

Thereafter, when the heating target point 1*a* of the object 1 to be heated is detected by the location detection sensor 600, a specific main solenoid plunger is stopped at a detection point, and thus the specific main high-frequency oscillation member 300 is arranged at a location where the specific main high-frequency oscillation member 300 can heat the heating target point 1*a* of the object 1 to be heated.

Thereafter, the remaining main solenoid plungers excluding the specific main solenoid plunger of the main solenoid plungers 410 are operated by the control unit 700 to the location where the specific main solenoid plunger has been stopped, thereby enabling the main high-frequency oscillation members 300 connected to the main solenoid plungers 410 at the locations where they can heat the heating target point 1*a* of the object 1 to be heated.

Thereafter, the thickness of the object 1 to be heated is detected, and the high-frequency oscillation time of the main high-frequency oscillators 320 is set in proportion to the thickness. In this case, it will be apparent that the present invention may further include a thickness detection sensor (not shown) configured to detect the thickness of the object 1 to be heated.

Finally, high-frequency waves are generated by the main high-frequency oscillators 320 in accordance with the set time, and heat the heating target point 1*a* of the object 1 to be heated.

Meanwhile, a contamination prevention coating layer coated with a composition for contamination prevention coating may be formed on each of the main high-frequency oscillators 320 in order to effectively prevent a contaminant from being attached and remove a contaminant. The composition for the contamination prevention coating includes boric acid and sodium carbonate at a molar ratio in the range from 1:0.01 to 1:2, and the total content of the boric acid and the sodium carbonate ranges from 1 to 10 wt % with respect to an overall aqueous solution. In addition, although sodium carbonate or calcium carbonate may be used as a material required to improve the coating property of the contamination prevention coating layer, sodium carbonate may be preferably used.

The molar ratio of the boric acid to the sodium carbonate preferably ranges from 1:0.01 to 1:2. When the molar ratio deviates from the range, a problem arises in that the coating property of a base material is reduced or in that the moisture adsorption of a surface is increased after coating and thus a coating film is removed.

The content of the boric acid and the sodium carbonate preferably ranges from 1 to 10 wt % with respect to the overall composition aqueous solution. When the content is less than 1 wt %, a problem arises in that the coating property of the base material is degraded. When the content is greater than 10 wt %, the precipitation of a crystal may easily occur due to an increase in the thickness of the coating film.

Meanwhile, a method of applying the composition for contamination prevention coating to the main high-frequency oscillators 320 is preferably a method of spraying the composition for contamination prevention coating. Furthermore, the thickness of the final coating film of each of the main high-frequency oscillators 320 preferably ranges from 500 to 2000 Å, and more preferably from 1000 to 2000 Å. When the thickness of the coating film is less than 500 Å, a problem arises in that degradation occurs in the case of high-temperature heat treatment. When the thickness is greater than 2000 Å, a disadvantage arises in that the precipitation ml of a crystal may easily occur on a coating surface.

Furthermore, the composition for contamination prevention coating may be prepared by adding 0.1 mole of boric acid and 0.05 mole of sodium carbonate to 1000 ml of distilled water and then agitating the mixture.

Furthermore, a polypropylene resin composition having desirable impact resistance against external impact or an external environment may be applied to the outer periphery of the shield housing 200. The polypropylene resin composition may include a polypropylene random block copolymer, including 75-95 wt % of ethylene-propylene-alpha-olefin random copolymer and 5-25 wt % of ethylene-propylene block copolymer having an ethylene content of 20-50 wt %.

The polypropylene random block copolymer preferably includes 75-95 wt % of ethylene-propylene-alpha-olefin random copolymer and 5-25 wt % of ethylene-propylene block copolymer, as described above. When the ethylene-propylene-alpha-olefin random copolymer is less than 75 wt %, rigidity is degraded. When the ethylene-propylene-alpha-olefin random copolymer is greater than 95 wt %, impact resistance is degraded. When the ethylene-propylene block copolymer is less than 5 wt %, impact resistance is degraded. When the ethylene-propylene-alpha-olefin random copolymer is greater than 25 wt %, rigidity is degraded.

The ethylene-propylene-alpha-olefin random copolymer includes 0.5-7 wt % of ethylene and 1-15 wt % of alpha olefin having 4 to 5 carbon atoms, and effectively functions to maintain the mechanical rigidity of the polypropylene resin composition, to improve heat resistance, and to maintain blush resistance. The content of the ethylene may preferably range from 0.5 to 5 wt %, and more preferably from 1 to 3 wt %. When the content of the ethylene is less than 0.5 wt %, blush resistance is degraded. When the content of the ethylene is greater than 7 wt %, the degree of crystallization and rigidity of the resin are degraded.

Furthermore, the alpha-olefin refers to any alpha olefin other than ethylene and propylene, and is preferably butene. Furthermore, when the above-described alpha olefin has carbon atoms less than 4 or greater than 5, it has low reactivity in connection with a comonomer during the preparation of the random copolymer, and thus there is difficulty preparing the copolymer. Furthermore, the ethylene-propylene-alpha-olefin random copolymer may include 1-15 wt % of alpha olefin, preferably 1-10 wt % of alpha olefin, and more preferably 3-9 wt % of alpha olefin.

When the alpha olefin is less than 1 wt %, a problem arises in that the degree of crystallization is excessively increased, and thus transparency is reduced. When the alpha olefin is greater than 15 wt %, a problem arises in that the degree of crystallization and rigidity are degraded and thus heat resistance is considerably degraded.

Furthermore, the ethylene-propylene block copolymer includes 20-50 wt % of ethylene, and functions which impart an impact resistant characteristic to the polypropylene resin composition and simultaneously impart blush resistance and transparency thanks to fine dispersion. The content of the ethylene may preferably range from 20 to 40 wt %. When the content of the ethylene is less than 20 wt %, impact resistance is degraded. When the content of the ethylene is greater than 50 wt %, impact resistance and blush resistance may be degraded.

Since the polypropylene resin composition is applied to the outer periphery of the shield housing 200, impact resistance against external impact or an external environment is improved.

Furthermore, a surface protection coating layer including a silicon component may be applied to the location detection sensors 600 in order to overcome erroneous indication and a surface contamination problem resulting in a reduction in lifespan.

The surface protection coating layer suppresses the attachment of microorganisms and floating particles, and thus can prevent erroneous indication and can semi-permanently extend the period of use of the location detection sensors 600.

A method of preparing a surface protection coating layer liquid is described in brief. First, a coating liquid is prepared by dissolving a dimethyldichlorosilane solution in an ethyl acetate solution at a volume content of 2-5%. In this case, when the content of the dimethyldichlorosilane solution is less than 2%, a sufficient coating effect cannot be obtained. When the content of the dimethyldichlorosilane solution is greater than 5%, the surface protection coating layer becomes excessively thick, and thus efficiency is degraded.

The viscosity of the coating liquid obtained at the above ratio preferably ranges from 0.8 to 2 cp (centipoise) when coating time and coating thickness are taken into account. The reason for this is that when the viscosity is excessively low, long coating time is required and that when the viscosity is excessively high, excessively thick coating is performed, coating is not sufficiently dried, and the erroneous indication of the sensors may be caused due to non-uniform coating.

In the present invention, the coating liquid prepared as described above is applied to the surfaces of the location detection sensors 600 to a thickness equal to or less than 1 μm. In this case, when the thickness of the surface protection coating layer is greater than 1 μm, the sensitivity of the sensors is rather degraded, and thus the thickness of the surface protection coating layer is limited to a value equal to or less than 1 μm in the present invention.

Furthermore, a method spraying the coating liquid onto the surfaces of the location detection sensors 600 two or three times may be used as a method applying the coating liquid to the above-described thickness.

Furthermore, a corrosion-proof coating layer made of a metallic surface coating material may be formed on the surfaces of the auxiliary high frequency dispersers 830 in order to prevent the corrosion of the surfaces resulting from a contaminant, or the like. The corrosion-proof coating layer is composed of 60 wt % of alumina powder, 30 wt % of $NH_4Cl$, 2.5 wt % of zinc, 2.5 wt % of copper, 2.5 wt % of magnesium, and 2.5 wt % of titanium.

Alumina powder is added for the purpose of preventing sintering, tangling, fusion, etc. during high-temperature heating. When alumina powder is added in an amount less than 60 wt %, the effect of preventing sintering, tangling, fusion, etc. is degraded. When alumina powder is added in an amount greater than 60 wt %, the above-described effect is not further improved, but material cost is considerably increased. Accordingly, alumina powder is preferably added in an amount of 60 wt %.

$NH_4Cl$ functions to react with aluminum, zinc, tin, copper and magnesium in a vapor state and to activate dispersion and infiltration. $NH_4Cl$ is added in an amount of 30 wt %. When $NH_4Cl$ is added in an amount less than 30 wt %, reaction with aluminum, zinc, tin, copper and magnesium in a vapor state is not desirably performed, and thus dispersion and infiltration are not activated.

In contrast, when $NH_4Cl$ is added in an amount greater than 30 wt %, the above-described effect is not further improved, but material cost is considerably increased. Accordingly, $NH_4Cl$ is preferably added in an amount of 30 wt %.

Zinc is mixed for the purpose of preventing the corrosion of metal in contact with water and performing electric anticorrosion. Zinc is mixed in an amount of 2.5 wt %. When the mixing percentage of zinc is greater than 2.5 wt %, the corrosion of metal in contact with water is not desirably prevented. In contrast, when the mixing percentage of zinc is greater than 2.5 wt %, the above-described effect is not further improved, but material cost is considerably increased. Accordingly, zinc is preferably mixed in an amount of 2.5 wt %.

Copper increases the hardness and tensile strength of metal in combination with the aluminum. Copper is mixed in an amount of 2.5 wt %. When the mixing percentage of copper is less than 2.5 wt %, copper does not desirably increase the hardness and tensile strength of metal when combined with the aluminum. In contrast, when the mixing percentage of copper is greater than 2.5 wt %, the above-described effect is not further improved, but material cost is considerably increased. Accordingly, copper is preferably mixed in an amount of 2.5 wt %.

Since pure metal of magnesium has low structural strength, magnesium is combined with zinc, and is mixed for the purpose of improving the hardness and tensile strength of metal and corrosion resistance against salt water. Magnesium is mixed in an amount of 2.5 wt %. When the mixing percentage of magnesium is less than 2.5 wt %, the hardness and tensile strength of metal and corrosion resistance against salt water are not considerably improved when magnesium is mixed with zinc. In contrast, when the mixing percentage of magnesium is greater than 2.5 wt %, the above-described effect is not further improved, but material cost is considerably increased. Accordingly, magnesium is mixed in an amount of 2.5 wt %.

Titanium is a light, hard transition metal element having corrosion resistance, and sheds silver-white metal luster. Since titanium has desirable corrosion resistance and low specific gravity and thus has a weight corresponding to 60% of that of steel, titanium is mixed for the purpose of reducing the weight of a coating material applied to a metallic base material, increasing luster, and having desirable waterproofness and corrosion resistance.

Titanium is mixed in an amount of 2.5 wt %. When the mixing percentage of titanium is less than 2.5 wt %, the weight of the coating material applied to the metallic base material is not significantly reduced, and a luster property, waterproofness, and corrosion resistance are not significantly improved. In contrast, when the mixing percentage of titanium is greater than 2.5 wt %, the above-described effect is not further improved, but material cost is considerably increased. Accordingly, titanium is preferably mixed in an amount of 2.5 wt %.

A method applying the coating material onto the surfaces of the auxiliary high frequency dispersers 830 according to the present invention is described below.

The auxiliary high frequency disperser 830 on which a coating layer is to be formed and the coating material which is formed at the mixing ratio are introduced together into a closed furnace, and argon gas is injected into the closed furnace at a rate of 2 L/min in order to prevent the auxiliary high frequency disperser 830 from being oxidized.

The closed furnace is maintained at a temperature of 700 to 800° C. for 4-5 hours in the state in which the argon gas has been injected.

Alumina powder, zinc, copper, magnesium and titanium in a vapor state are formed inside the closed furnace by performing the above step, and the mixture of aluminum powder, alumina powder, zinc, copper, magnesium and titanium is infiltrated into the surfaces of a base material and forms a coating layer.

When a coating material/base material composite is maintained inside the closed furnace at a temperature of 800 to 900° C. for 30-40 hours after the coating layer has been formed, a corrosion-proof coating layer is formed on the surfaces of the auxiliary high frequency disperser 830, thereby isolating the surfaces of the auxiliary high frequency disperser 830 from external air. In this case, during the performance of the process, an abrupt change in temperature may cause the corrosion-proof coating layer to be separated from the surfaces of the auxiliary high frequency disperser 830, and thus a change in temperature is performed at a rate of 60° C./hr.

The corrosion-proof coating layer according to the present invention has the following advantages:

The corrosion-proof coating layer according to the present invention has a very wide range of purposes, and thus the corrosion-proof coating layer may be applied by using various methods, such as curtain coating, spray painting, dip coating, flooding, etc.

The corrosion-proof coating layer according to the present invention can be applied to a very thin layer thickness in addition to performing the function of protection against corrosion and/or scale, and thus can improve electrical conductivity and reduce materials and cost. When high electrical conductivity is preferably after a hot forming process, a thin, electrically conductive primer may be applied to the top of the coating layer.

After a forming process or a hot forming process, the coating material may be maintained on the surfaces of the base material. For example, the coating material increases scratch resistance, improves corrosion protection, provides an aesthetic appearance, prevents discoloration, and changes electrical conductivity, and may be provided as a primer for a conventional downstream process (for example, phosphorizing and electrophoresis dip coating).

According to the present invention, the corrosion prevention coating layer made of alumina powder, $NH_4Cl$, zinc, copper, magnesium, and titanium is applied to the auxiliary high frequency dispersers 830 according to the present invention, thereby preventing the corrosion of the surfaces of the auxiliary high frequency dispersers 830 resulting from dust, contaminant, etc.

Furthermore, a coating layer made of zirconium nitride (ZrN) may be formed on the high-frequency oscillation coil 321 to a thickness of 0.2-1.0 μm in order to improve abrasion resistance and corrosion resistance.

The step of forming the coating layer may be performed by sputtering or physical vapor deposition (PVD) using cathodic arc discharge.

When the thickness is less than 0.2 μm, the attachment of the coating layer is not desirably achieved. When the thickness is greater than 1.0 μm, no particular characteristic appears. Accordingly, the thickness of the coating layer preferably ranges from 0.2 to 1.0 μm.

The above-described coating layer improves not only the mechanical characteristics of the high-frequency oscillation coil 321 but also the corrosion resistance thereof.

The invention claimed is:

1. A high-frequency heating apparatus for a progressive die, the high-frequency heating apparatus comprising:

an open-top shield housing (200) made of a ferrite material which shields electromagnetic waves;

a plurality of main high-frequency oscillation members (300) radially arranged around a center of the shield housing (200);

main extension/reduction transfer members (400) configured to transfer the main high-frequency oscillation members (300) in directions in which an arrangement radius is selectively extended and reduced; and a high-frequency oscillation controller (500) configured to activate the main high-frequency oscillation members (300) by applying high-frequency signals to the main high-frequency oscillation members (300), thereby causing the main high-frequency oscillation members (300) to generate high-frequency waves;

wherein each of the main high-frequency oscillation members (300) comprises: a main oscillator housing (310) configured to have a high-frequency wave emission hole (311) in a top thereof; a main high-frequency oscillator (320) configured to generate high-frequency waves via the high-frequency wave emission hole (311) in a state of being installed inside the main oscillator housing (310); and a main high-frequency wave disperser (330) coupled to the top of the main oscillator housing (310), and configured to have a high-frequency wave dispersion hole (331) adapted to disperse the high-frequency waves, emitted via the high-frequency wave emission hole (311), to an outside; and wherein the main extension/reduction transfer members (400) comprise respective main solenoid plungers (410) configured to selectively move the main oscillator housings (310), containing the respective main high-frequency oscillators (320), forward and backward in a direction of a center of the shield housing (200) in a state of being radially installed along an outer circumferential surface of the shield housing (200).

2. The high-frequency heating apparatus of claim 1, further comprising a location control means configured to control locations of the main high-frequency oscillation members (300);

wherein the location control means comprises:

a location detection sensor (600) configured to detect a heating target point (1*a*) of an object (1) to be heated in response to an operation of one of the main solenoid plungers (410) in a state of being installed at a front end of one of the oscillator housings, wherein when the heating target point (1*a*) of the object (1) to be heated is detected by the location detection sensor (600), one of the main high-frequency oscillation members on which the location detection sensor (600) has been installed maintains a detection location, and remaining ones of the main high-frequency oscillation members are automatically arranged in accordance with the location of the specific main high-frequency oscillation member as degrees of forward or backward movement of corresponding ones of the main solenoid plungers (410) are adjusted in response to control signals of a control unit (700).

3. The high-frequency heating apparatus of claim 2, further comprising:

auxiliary high-frequency oscillation members (800) configured to selectively generate high-frequency waves by means of the high-frequency oscillation controller (500) in response to control signals of the control unit (700) in a state of being disposed between the main high-frequency oscillation members (300); and auxiliary extension/reduction transfer members (900) configured to transfer the auxiliary high-frequency oscillation members (800) in directions in which the arrangement radius is selectively extended and reduced;

wherein each of the auxiliary high-frequency oscillation members (800) comprises: an auxiliary oscillator housing (810) configured to have a high-frequency wave emission hole (811) in a top thereof; an auxiliary high-frequency oscillator (820) configured to generate high-frequency waves via the high-frequency wave emission hole (811) in a state of being installed inside the auxiliary oscillator housing (810); and an auxiliary high frequency disperser (830) coupled to the top of the auxiliary oscillator housing (810), and configured to have a high-frequency wave dispersion hole (831) adapted to disperse the high-frequency waves, emitted via the high-frequency wave emission hole (811), to the outside; and wherein the auxiliary extension and reduction transfer members (900) comprises auxiliary solenoid plungers (910) configured to selectively move the auxiliary oscillator housings (810), containing the respective auxiliary high-frequency oscillators (820), forward and backward in the direction of the center of the shield housing (200) in a state of being disposed between the main solenoid plungers (410) along the outer circumferential surface of the shield housing (200).

4. A high-frequency heating method for a progressive die using a high-frequency heating apparatus for the progressive die, the high-frequency heating apparatus comprising:

an open-top shield housing (200) made of a ferrite material which shields electromagnetic waves;

a plurality of main high-frequency oscillation members (300) radially arranged around a center of the shield housing (200);

main extension/reduction transfer members (400) configured to transfer the main high-frequency oscillation members (300) in directions in which an arrangement radius is selectively extended and reduced; and a high-frequency oscillation controller (500) configured to activate the main high-frequency oscillation members (300) by applying high-frequency signals to the main high-frequency oscillation members (300), thereby causing the main high-frequency oscillation members (300) to generate high-frequency waves;

wherein each of the main high-frequency oscillation members (300) comprises: a main oscillator housing (310) configured to have a high-frequency wave emission hole (311) in a top thereof; a main high-frequency oscillator (320) configured to generate high-frequency waves via the high-frequency wave emission hole (311) in a state of being installed inside the main oscillator housing (310); and a main high-frequency wave disperser (330) coupled to the top of the main oscillator housing (310), and configured to have a high-frequency wave dispersion hole (331) adapted to disperse the high-frequency waves, emitted via the high-frequency wave emission hole (311), to an outside; and wherein the main extension/reduction transfer members (400) comprise respective main solenoid plungers (410) configured to selectively move the main oscillator housings (310), containing the respective main high-frequency oscillators (320), forward and backward in a direction of a center of the shield housing (200) in a state of being radially installed along an outer circumferential surface of the shield housing (200);

the method comprising:

when an object (1) to be heated reaches a predetermined location, detecting a heating target point (1*a*) of the object (1) to be heated by means of a location detection sensor (600) while a main solenoid plunger is selectively moving forward and backward;

when the heating target point (1*a*) is detected, arranging the specific main high-frequency oscillation member at a location, at which the main high-frequency oscillation member can heat the heating target point (1*a*) of the object (1) to be heated, by stopping the main solenoid plunger at a detection point;

arranging all main high-frequency oscillation members (300), connected to remaining main solenoid plungers, at locations, at which the main high-frequency oscillation members (300) can heat the heating target point (1*a*) of the object (1) to be heated, by operating the remaining main solenoid plungers to the location, at which the main solenoid plunger has been stopped, by means of a control unit (700);

detecting a thickness of the object (1) to be heated, and setting high-frequency oscillation time in the main high-frequency oscillators (320) in proportion to the thickness; and heating the heating target point (1*a*) of the object (1) to be heated by generating high-frequency waves by means of the main high-frequency oscillators (320) in accordance with the set time.

5. A high-frequency heating method for a progressive die using a high-frequency heating apparatus for the progressive die, the high-frequency heating apparatus comprising:

an open-top shield housing (200) made of a ferrite material which shields electromagnetic waves;

a plurality of main high-frequency oscillation members (300) radially arranged around a center of the shield housing (200);

main extension/reduction transfer members (400) configured to transfer the main high-frequency oscillation members (300) in directions in which an arrangement radius is selectively extended and reduced; and a high-frequency oscillation controller (500) configured to activate the main high-frequency oscillation members (300) by applying high-frequency signals to the main high-frequency oscillation members (300), thereby causing the main high-frequency oscillation members (300) to generate high-frequency waves;

wherein each of the main high-frequency oscillation members (300) comprises: a main oscillator housing (310) configured to have a high-frequency wave emission hole (311) in a top thereof; a main high-frequency oscillator (320) configured to generate high-frequency waves via the high-frequency wave emission hole (311) in a state of being installed inside the main oscillator housing (310); and a main high-frequency wave disperser (330) coupled to the top of the main oscillator housing (310), and configured to have a high-frequency wave dispersion hole (331) adapted to disperse the high-frequency waves, emitted via the high-frequency wave emission hole (311), to an outside; and wherein the main extension/reduction transfer members (400) comprise respective main solenoid plungers (410) configured to selectively move the main oscillator housings (310), containing the respective main high-frequency oscillators (320), forward and backward in a direction of a center of the shield housing (200) in a state of being radially installed along an outer circumferential surface of the shield housing (200);

the method comprising:

when the object (1) to be heated reaches a predetermined location, detecting a heating target point (1*a*) of the object (1) to be heated by means of the location detection sensor (600) while a main solenoid plunger is selectively moving forward and backward;

when the heating target point (1*a*) is detected, arranging a main high-frequency oscillation member at a location, at which the main high-frequency oscillation member can heat the heating target point (1*a*) of the object (1) to be heated, by stopping the main solenoid plunger at a detection point;

arranging all main high-frequency oscillation members (300), connected to remaining main solenoid plungers, at locations, at which the main high-frequency oscillation members (300) can heat the heating target point (1*a*) of the object (1) to be heated, by operating the remaining main solenoid plungers to the location, at which the main solenoid plunger has been stopped, by means of the control unit (700);

detecting a thickness of the object (1) to be heated, and setting high-frequency oscillation time in the main high-frequency oscillators (320) in proportion to the thickness; and heating the heating target point (1*a*) of the object (1) to be heated by generating high-frequency waves by means of the main high-frequency oscillators (320) in accordance with the set time.

* * * * *